US006334531B1

(12) United States Patent
Valkovich

(10) Patent No.: US 6,334,531 B1
(45) Date of Patent: Jan. 1, 2002

(54) PLASTIC BOTTLE CARRIER

(76) Inventor: Maria Agneza Valkovich, 7945-116$^{th}$ Street, Delta, British Columbia (CA), V4C 5T7

( * ) Notice: Subject to any disclaimer, the term of this patent is extended or adjusted under 35 U.S.C. 154(b) by 0 days.

(21) Appl. No.: 09/589,759

(22) Filed: Jun. 9, 2000

(51) Int. Cl.$^{7}$ ..... B65D 75/00
(52) U.S. Cl. ..... 206/163; 294/87.2
(58) Field of Search ..... 206/147, 149, 206/151, 158, 162, 199, 161, 163, 427; 294/87.2

(56) References Cited

U.S. PATENT DOCUMENTS

| | | | | | |
|---|---|---|---|---|---|
| D110,691 | S | * | 8/1938 | Dudley | 206/199 |
| 2,431,713 | A | * | 12/1947 | Stigler | 206/199 |
| 2,460,530 | A | * | 2/1949 | Petyak | 206/199 |
| 2,510,591 | A | * | 6/1950 | Listman | 206/199 |
| D180,901 | S | * | 9/1957 | Glazer | 206/199 |
| 3,003,805 | A | * | 10/1961 | Glazer | 206/150 |
| 3,612,595 | A | | 10/1971 | Updegraff et al. | |
| 3,804,309 | A | | 4/1974 | Kwak | |
| 3,860,112 | A | | 1/1975 | Klygis | |
| 4,037,766 | A | | 7/1977 | Iacono | |
| 4,093,295 | A | | 6/1978 | Erickson | |
| 4,159,841 | A | | 7/1979 | Calvert | |
| 4,247,142 | A | | 1/1981 | Erickson | |
| 4,798,286 | A | | 1/1989 | Muscanelli | |
| 4,917,428 | A | | 4/1990 | Sola | |
| 5,168,990 | A | | 12/1992 | Johnson | |
| 5,188,413 | A | | 2/1993 | Nathan | |
| 5,199,562 | A | | 4/1993 | Adami et al. | |
| 5,290,083 | A | | 3/1994 | Rissley | |
| 5,413,395 | A | | 5/1995 | Stewart | |
| 5,441,320 | A | | 8/1995 | Strong | |
| 5,480,204 | A | | 1/1996 | Erickson | |
| 5,487,465 | A | * | 1/1996 | Broskow | 206/150 |
| 5,707,096 | A | | 1/1998 | Gregory | |
| 5,765,888 | A | | 6/1998 | Stack | |
| 5,868,659 | A | | 2/1999 | Slomski | |
| 5,882,057 | A | | 3/1999 | Fahy | |

* cited by examiner

*Primary Examiner*—Paul T. Sewell
*Assistant Examiner*—Shian Luong

(57) ABSTRACT

A plastic bottle carrier includes a support member formed with bottle neck retainers for suspending engagement with necks of plastic bottles and a slot extending through the support member along an imaginary centerline. A handle extends upwardly through the slot, and has a lower portion projecting beyond the slot beneath the support member to support the support member on the lower portion of the handle. The handle also has an upper portion projecting above the support member from the lower portion, and an opening formed in the upper portion, with a handgrip extending above the opening and defining an upper limit of the opening. The upper portion is dimensioned so as to be slidable through the slot for insertion of the upper portion through the slot and removal of the upper portion from the slot.

3 Claims, 3 Drawing Sheets

PLASTIC BOTTLE CARRIER

BACKGROUND OF THE INVENTION

1. Field of the Invention

The present invention relates to a plastic bottle carrier which is provided with bottle neck retainers shaped for suspending engagement with the necks of plastic bottles so as to allow the plastic bottles to be conveniently carried.

2. Description of the Related Art

Various carriers have previously been proposed for engagement with the necks of plastic bottles to facilitate carrying of the bottles.

For example, in U.S. Pat. No. 5,188,413, issued Feb. 23, 1993 to Walter Nathan there is disclosed a unitary plastic bottle carrier assembly which has split collar assemblies for, supporting the bottles by contact with neck rings located below closures on the bottles. The split collar assemblies are connected to a central support member, and a handle is assembled with the support member. The handle comprises a central elongated strip that has end portions in the form of rectangular pads secured at right angles to the ends of the strip. During the assembly of the handle to the support member, the end pads are turned parallel to the strip portion and are moved through openings in the support member, after which they are flattened out so as to underlie the support member and to prevent the handle from being removed when the carrier and associated bottles are lifted.

It is, however, a disadvantage of this prior arrangement that the handle cannot be easily assembled with and removed from the support member.

Thus, to attach the handles to the support member, it is necessary to deform the handle so as to allow the rectangular pads to fit through the slots. Likewise, to remove the handle from the support member, it is be necessary to again deform the handle so as to enable the rectangular pads to be withdrawn through the slots. Such deformation of the handle and displacement of the support pads through the slots would be difficult or even impossible for an impaired, e.g. arthritic, person.

BRIEF SUMMARY OF THE INVENTION

It is accordingly an object of the present invention to provide a novel and improved plastic bottle carrier which comprises two components which can be very easily assembled an disassembled.

According to the present invention, a plastic bottle carrier comprises first and second components of moulded plastic material. The first component comprises a support member formed with bottle neck retainers for suspending engagement with necks of plastic bottles and a slot extending through the support member along an imaginary centerline of the support member. The second component comprises a handle extending upwardly through the slot, the handle having a lower portion projecting beyond the slot beneath the support member to support the support member on the lower portion of the handle. The handle also has an upper portion projecting above the support member from the lower portion, and an opening formed in the upper portion, with a handgrip extending above the opening and defining an upper limit of the opening. The upper portion is dimensioned so as to be slidable through the slot for insertion of the upper portion through the slot and removal of the upper portion from the slot.

The handle in the plastic bottle according to the present invention is required to be inserted through only one slot in the support member, and no deformation of the handle for that purpose is required. Consequently, it is a very easy matter, even for a physically impaired person, to simply slide the handle upwardly through the slot in the support member for the purpose of assembling the support member and the handle and, likewise, to simply withdraw or push the handle downwardly through the slot to disassemble the handle from the support member.

Furthermore, since no deformation of the handle is required for this purpose, the handle is not required to be flexible and, consequently, can be made relatively thick so that, by providing the underside of the handle with a convexly curved surface, the weight of the entire carrier and any bottles suspended from the carrier can be supported by fingers inserted through the opening without hurting or even cutting or otherwise damaging the fingers.

BRIEF DESCRIPTION OF THE DRAWINGS

The invention will be more readily understood from the following description of a preferred embodiment thereof given, by way of example, with reference to the accompanying drawings, in which.

DESCRIPTION OF THE PREFERRED EMBODIMENT

Figure 1:
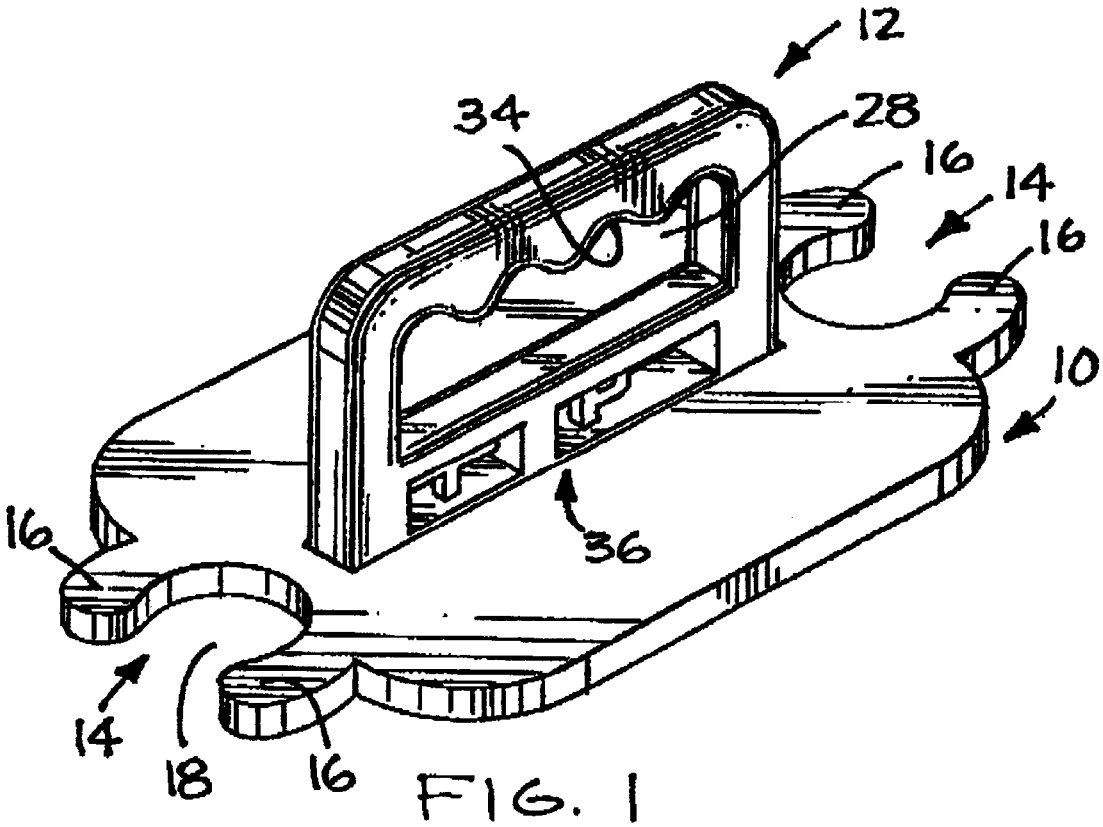
FIG. 1 shows a view in perspective of a plastic bottle carrier embodying the present invention in an assembled condition.

The bottle carrier illustrated in the accompanying drawings comprises a first component, indicated generally by reference numeral 10, which forms a support member, and a second component indicated generally by reference numeral 12, which forms a rigid handle, both of these components 10 and 12 being moulded of plastic material.

The support member 10 is flat and elongate and has opposite ends which are formed as bottle neck retainers indicated generally by reference numerals 14. The bottle neck retainers each comprise a pair of curved projections 16 at opposite sides of a circularly curved recess 18 which serves, in known manner, to receive the neck of a plastic bottle for suspending the plastic bottle from the support member 10.

Figure 3:
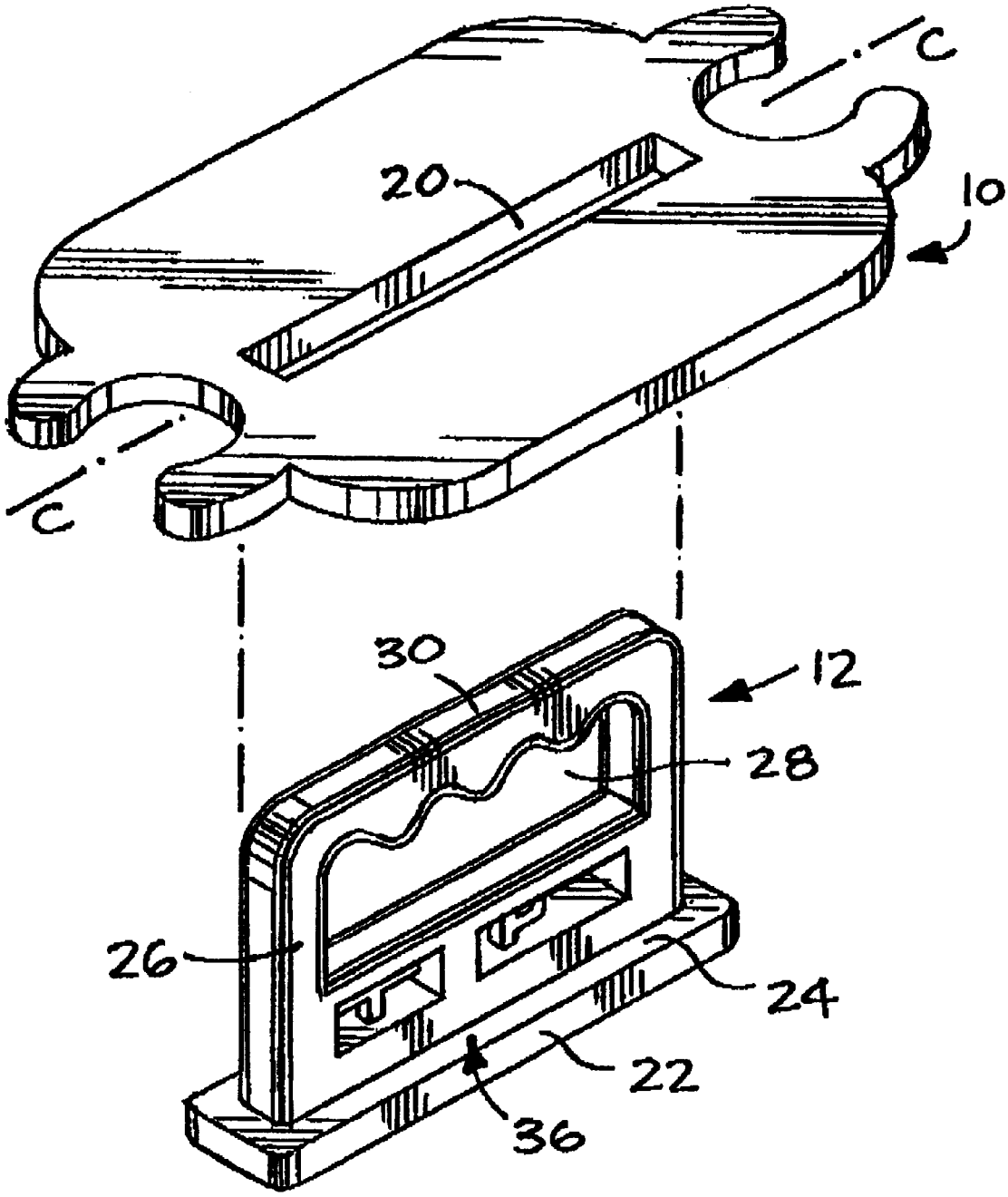
FIG. 3 shows an exploded view, in perspective, of the bottle carrier of FIGS. 1 and 2.

Referring now to FIG. 3, it will be seen that the support member 10 is formed with a longitudinally extending slot 20. More particularly, the slot 20 extends along an imaginary centerline C of the support member 10, and the bottle neck retainers are each symmetrical about the centerline C.

The handle 12 has a lower portion in the form of a peripheral flange 22, which extends laterally from the handle 12 and which has a flat upper surface 24. The handle 12 also comprises an upper portion 26, which is formed in one piece with the lower portion 22 and which extends upwardly at right angles to the surface 24 of the flange 22.

The upper portion 26 has a length and a width which are each slightly less than the length and the width, respectively, of the slot 20, so that the upper portion 26 can easily be pushed or slid upwardly through the slot 20 from below the support member 10. When the upper portion 26 is fully inserted through the slot 20, the surface 24 of the flange 22 projects beneath the support member 10 beyond the opposite sides and the ends of the slot 20, in surface-to-surface contact with the undersurface of the support member 10, as illustrated in FIG. 4, so that the support member 10, and any plastic bottles engaged with the support member 10, are supported by the handle 12.

Figure 2:
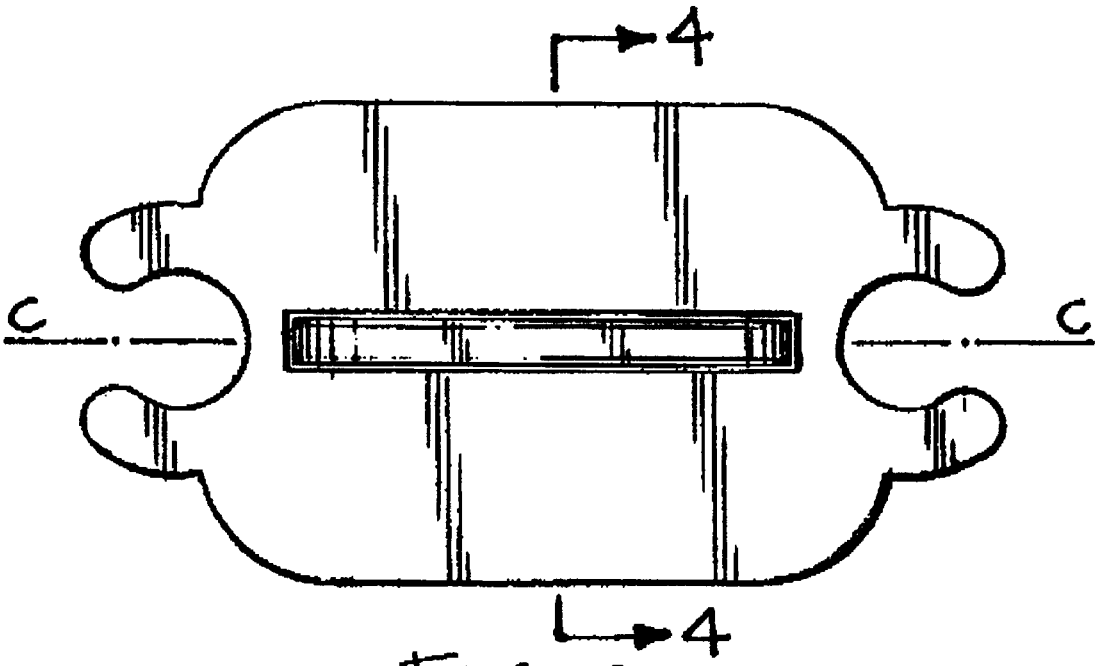
FIG. 2 shows a plan view of the bottle carrier of FIG. 1.
Figure 4:
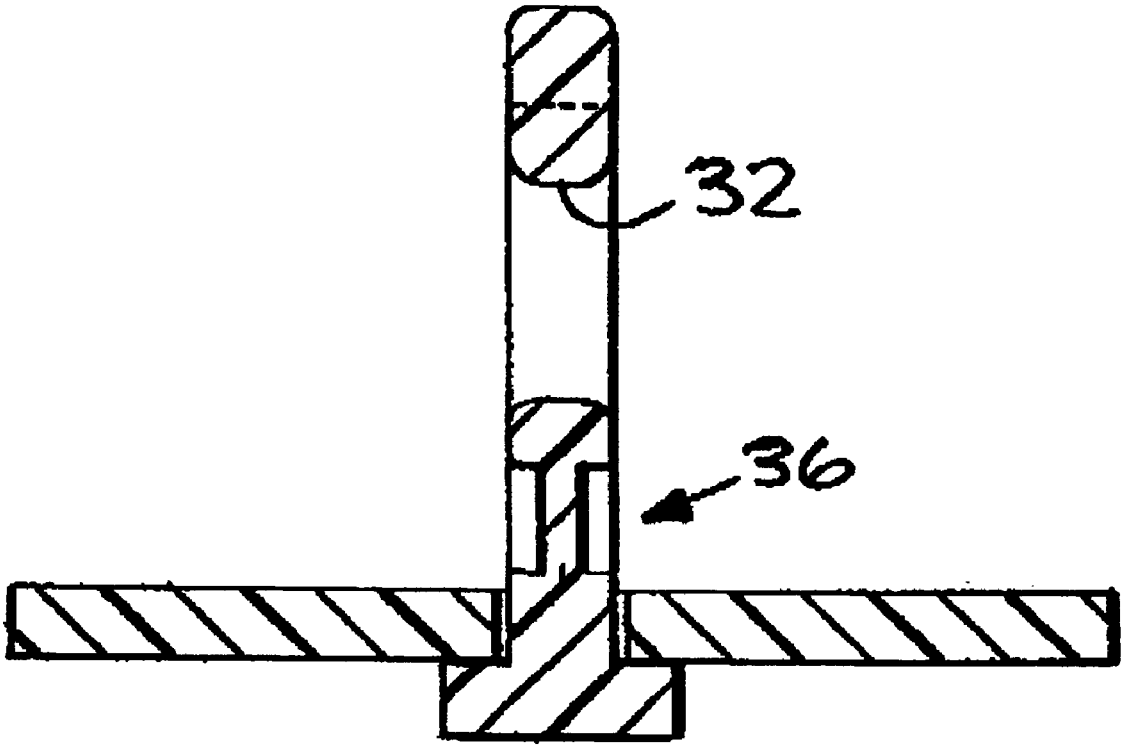
FIG. 4 shows a view taken in cross-section along the line 4—4 of FIG. 2.

The handle 12 is formed with an opening 28, the upper limit of which is defined by a handgrip 30 which, when the carrier is assembled as shown in FIGS. 1, 2 and 4, extends above and along the slot 20.

The handgrip 30, as shown in FIG. 4, has a lower surface 32 which is convexly curved, transversely of the handgrip 30, so that the underside of the handgrip 30 does not present any edges which might hurt or even damage the fingers of the user. Also, as can be seen in FIGS. 1 and 3, the underside of the handgrip 30 is corrugated, longitudinally of the handgrip 30, so as to provide a plurality of downwardly open concave recesses, one of which is indicated in FIG. 1 by reference numeral 34, to facilitate gripping of the handle 12 by the fingers of the user when these fingers have been inserted through the opening 28.

As will be apparent to those skilled in the art, various modifications maybe made in the above-described bottle carrier within the scope of the invention as defined by the appended claims.

For example, the bottle neck retainers 14 may be replaced by different bottle neck retainers, which may be similar to those already known in the art, and four of such retainers may be distributed in a symmetrical fashion around the slot 20.

The handle 12 has an intermediate portion, indicated generally by reference numeral 36 in FIGS. 1, 3 and 4, which may be formed with recessed letters. The intermediate portion 12 extends, as shown, between the opposite end of the slot 20 and projects upwardly from the slot 20. In the present embodiment of the invention, the letters "T" and "P" are recessed into this intermediate portion 36. As will be apparent, instead these letters, other lettering, wording or design features may be provided on this intermediate portion, by embossing, printing, labelling or any other suitable means.

I claim:

1. A plastic bottle carrier, comprising:

first and second components of molded plastic material;

said first component comprising a support member formed with a pair of bottleneck retainers shaped for suspending engagement with the necks of plastic bottles and a slot extending along an imaginary centerline of the said support member and having a length and a width;

said pair of bottleneck retainers being provided at opposite ends of said support member and each being symmetrical about the said imaginary centerline; and said second component comprising a rigid handle extending upwardly through said slot;

said handle having an upper portion and a lower portion formed in one piece with said upper portion;

said upper portion having a length and a width which are each slightly less than the length and the width, respectively, of said slot; and said lower portion comprising a peripheral, laterally extending flange;

said upper portion extending at right angles to said flange; and said flange extending beneath said support member beyond opposite sides and opposite ends of said slot in surface-to-surface contact with said support member;

an opening formed in said upper portion; and a handgrip extending above said slot and defining an upper limit of said opening;

said upper portion being dimensioned so as to be slidable through said slot for insertion of said upper portion through said slot and removal of said upper portion from said slot.

2. A plastic bottle carrier as claimed in claim 1, wherein said handle includes an intermediate portion extending between the opposite ends of said slot.

3. A plastic bottle carrier as claimed in claim 2, wherein said intermediate portion projects upwardly from said slot and is provided with lettering.

* * * * *